United States Patent [19]

Newsom et al.

[11] 4,077,152

[45] Mar. 7, 1978

[54] PRAIRIE DOLL HOUSE

[75] Inventors: Donald Newsom; Clara Newsom, both of Sutter Creek, Calif.

[73] Assignee: The Raymond Lee Organization, Inc., New York, N.Y.

[21] Appl. No.: 708,312

[22] Filed: Jul. 26, 1976

[51] Int. Cl.[2] ..... A63H 33/00

[52] U.S. Cl. ..... 46/12

[58] Field of Search ..... 46/19, 21, 12, 20; 35/16

[56] References Cited

U.S. PATENT DOCUMENTS

| | | | |
|---|---|---|---|
| 1,287,771 | 12/1918 | Schmitt | 46/20 |
| 1,521,420 | 12/1924 | Beebe | 35/16 UX |
| 1,801,724 | 4/1931 | Conklin | 35/16 |
| 3,751,848 | 8/1973 | Ahlstrand | 46/19 |

FOREIGN PATENT DOCUMENTS

| | | | |
|---|---|---|---|
| 588,518 | 5/1947 | United Kingdom | 46/19 |

*Primary Examiner*—F. Barry Shay

*Attorney, Agent, or Firm*—Howard I. Podell

[57] ABSTRACT

A doll house shaped as a wooden prairie house fitted with a removable roof, together with furniture mountable in the house. The interior of the house is formed with a balcony floor and staircase leading to the ground floor level. A fireplace and chimney is mounted in the house in a recess on the floor thereof with the chimney, or rectangular cross-section, extending freely through a rectangular opening in the removable roof so as to latch the roof in place.

1 Claim, 7 Drawing Figures

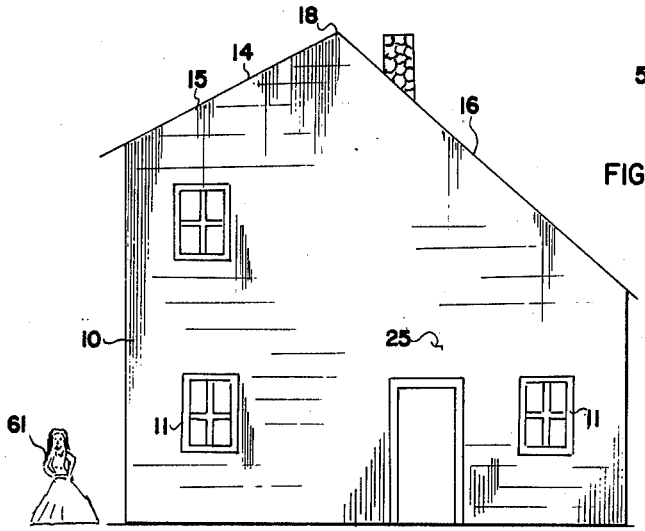
FIG. 1
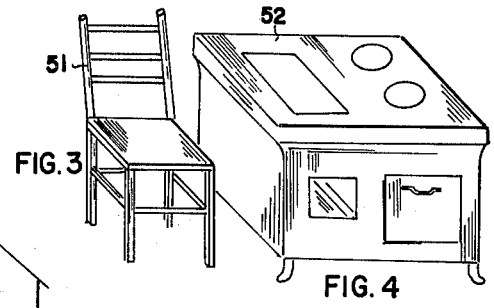
FIG. 3
FIG. 4
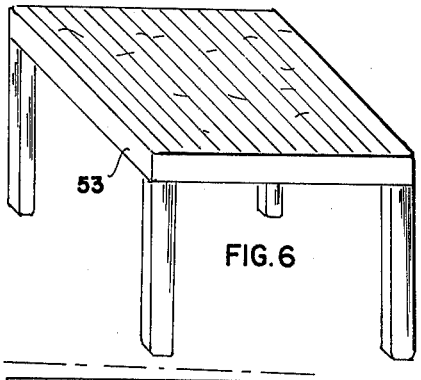
FIG. 6
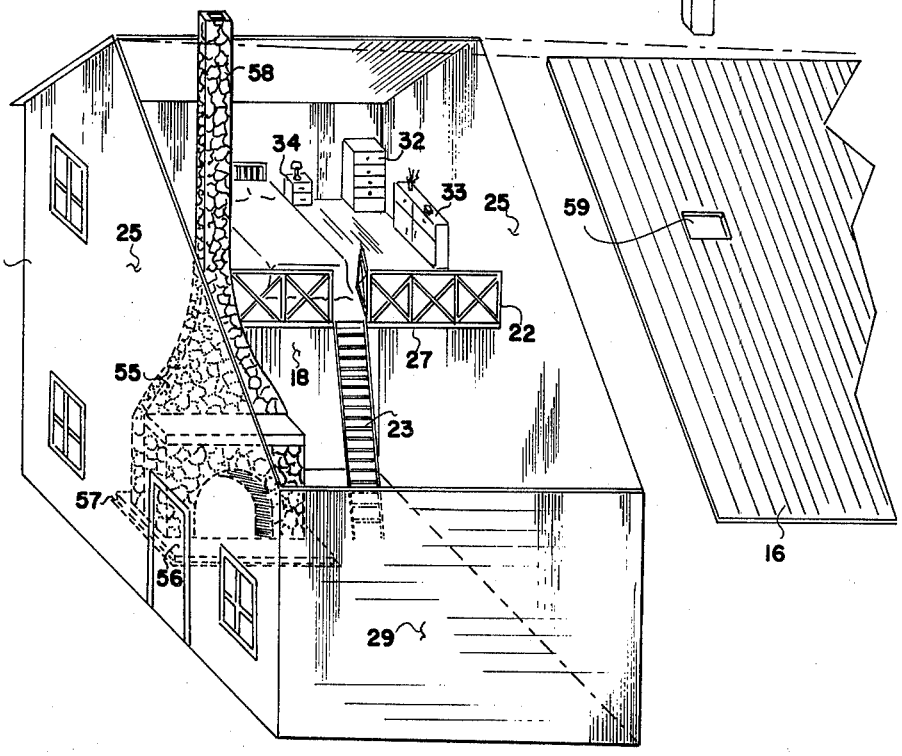
FIG. 2
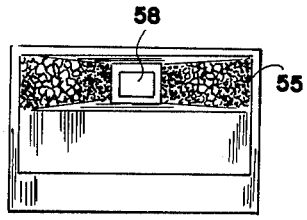
FIG. 5
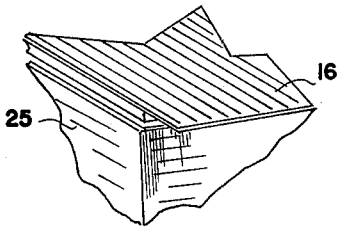
FIG. 7

PRAIRIE DOLL HOUSE

SUMMARY OF THE INVENTION

Our invention is a doll house shaped as a wooden prairie house fitted with a removable roof, together with furniture mountable in the house. The interior of the house is formed with a balcony floor and staircase leading to the ground floor level. A fireplace and chimney is mounted in the house with the chimney, of rectangular cross-section, extending freely through a rectangular opening in the removable roof so as to latch the roof in place.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a side view of the doll house and a doll;

FIG. 2 is a perspective exploded view of the house and roof;

FIG. 3 is a perspective view of a chair of the house;

FIG. 4 is a perspective view of a stove of the house;

FIG. 5 is a plan view of the fireplace and chimney;

FIG. 6 is a perspective view of a table of the house; and

FIG. 7 is a detail view of the roof and house.

DESCRIPTION OF THE PREFERRED EMBODIMENT

Turning now descriptively to the drawings, in which similar reference characters denote similar elements throughout the several views; FIGS. 1–2 illustrate the doll house 10 which is shaped to resemble a prairie house and fitted with window openings 11. The roof unit 14 is formed of a section 15 fixed to the house and a section 16 that is removable to provide access to the interior 18, with both roof sections 15 and 16 oriented on intersecting diagonal planes that meet on a common ridge line 18.

A balcony floor 21 is fixed to the walls 25 in the interior of the house with a balcony rail 22 extending from a free edge 27 of the floor 21 and with a ladder 23 leading from the balcony floor 21 to the base floor 28.

Furniture such as beds 31, chests 32, 33 and 34, are mounted on balcony floor 21 and other typical prairie style furniture such as a chair 51, a stove 52 and a table 53 shown in FIGS. 3, 4, and 6 may be installed on base floor 28.

An integral fireplace and chimney unit 55 is mounted on a rectangular base plate 56 that freely fits in a rectangular recess 57 in the base floor 28, with the chimney section 58, of rectangular cross-section, extending above the detachable roof section 16 through a mating rectangular recess 59 of roof section 16, so as to latch roof section 16 in place resting on the top of external walls 25 and 29, when the base plate 56 is set into floor recess 57.

One or more dolls 61 may be placed inside or outside of the house 10 as desired.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A doll house formed with a one-piece detachable roof section, said roof section resting freely on the top of walls of the house in a plane diagonally inclined to the vertical in the installed position thereof, together with a fireplace unit that is detachably mounted in the interior of the doll house, said fireplace unit having a base and an integral vertical chimney of rectangular cross-section that extends freely through an opening of rectangular cross-section in the detachable roof section, so as to latch said roof section in place, said opening of said roof section being bounded on each of four sides by an angle of a length to fit about the external cross-section of the chimney in the diagonal plane of the installed position of the detachable roof section, together with a base floor section having means for locating said fireplace unit base and a balcony floor section mounted in the interior of said house, with said balcony section located so that a portion of the base floor section and of the balcony section are exposed to view and are accessible for the placement of furniture on said floor section and balcony section when the detachable roof section is removed.

* * * * *